US008529281B2

(12) United States Patent
Nakatsuji et al.

(10) Patent No.: US 8,529,281 B2
(45) Date of Patent: Sep. 10, 2013

(54) CONNECTOR

(75) Inventors: Naohiro Nakatsuji, Kariya (JP); Masao Tada, Kariya (JP); Shinichiro Komaki, Kariya (JP); Akihiro Tanaka, Yao (JP)

(73) Assignees: Toyota Boshoku Kabushiki Kaisha, Kariya-shi (JP); Hosiden Corporation, Yao-shi (JP)

( * ) Notice: Subject to any disclaimer, the term of this patent is extended or adjusted under 35 U.S.C. 154(b) by 14 days.

(21) Appl. No.: 13/306,007

(22) Filed: Nov. 29, 2011

(65) Prior Publication Data

US 2012/0196468 A1 Aug. 2, 2012

(30) Foreign Application Priority Data

Jan. 28, 2011 (JP) ..... 2011-016958

(51) Int. Cl.
*H01R 4/50* (2006.01)

(52) U.S. Cl.
USPC ..... 439/345

(58) Field of Classification Search
USPC ..... 439/345, 754, 79, 728; 128/639
See application file for complete search history.

(56) References Cited

U.S. PATENT DOCUMENTS 5,944,562 A * 8/1999 Christensson ..... 439/729
6,129,562 A * 10/2000 Hong ..... 439/79
6,357,089 B1 * 3/2002 Koguchi et al. ..... 24/536
7,311,560 B2 * 12/2007 Ehr et al. ..... 439/729
7,722,412 B2 * 5/2010 Ehr et al. ..... 439/729
7,736,200 B2 * 6/2010 Sproesser ..... 439/754
7,740,510 B2 * 6/2010 Muz ..... 439/759
2005/0160567 A1 * 7/2005 Liou ..... 24/505
2007/0078458 A1 * 4/2007 Dumbauld et al. ..... 606/51
2008/0083806 A1 * 4/2008 Scirica ..... 227/175.1
2009/0171350 A1 * 7/2009 Dycus et al. ..... 606/48
2010/0275740 A1 * 11/2010 Norin ..... 81/338

FOREIGN PATENT DOCUMENTS

JP 2000-28742 1/2000
JP 2001-291536 A1 10/2001

* cited by examiner

*Primary Examiner* — Alexander Gilman
(74) *Attorney, Agent, or Firm* — Kratz, Quintos & Hanson, LLP

(57) ABSTRACT

The invention provides a connector including first and second beams, first and second conductive plates, and an urging device. The first and second beams extend substantially in parallel with each other and include first and second accommodating recesses, respectively. The first and second recesses are opposed to each other and open toward distal end sides of the first and second beams. The first and second conductive plates are to be accommodated in the first and second accommodating recesses, respectively, and removably insertable from the distal end sides into the first and second accommodating recesses, respectively. The urging device urges the first and second conductive plates in directions close to each other.

10 Claims, 9 Drawing Sheets

CONNECTOR

The present application claims priority under 35 U.S.C. §119 of Japanese Patent Application No. 2011-016958 filed on Jan. 28, 2011, the disclosure of which is expressly incorporated by reference herein in its entity.

BACKGROUND OF THE INVENTION

1. Technical Field

The present invention relates to connectors that are connectable electric conductors such as a conductive fabric.

2. Background Art

A conventional connecting terminal connectable to a conductive fabric includes a hook to be locked in a hole formed in a conductive fabric, a contact provided on the hook and electrically connectable to the conductive fabric, and a cable connected to the contact, as disclosed in Japanese Unexamined Patent Publication Nos. 2001-291536 and 2000-28742.

SUMMARY OF INVENTION

A drawback of the above connecting terminal is the difficulty in changing a connection position of the connecting terminal and the conductive fabric because it is required to make a hole in the conductive fabric. Another drawback is unstable connection between the connecting terminal and the conductive fabric because making the hole may damage an electrode in the conductive fabric. Further, as the connecting terminal is configured such that its contact is in contact with the conductive fabric in the state where the hook is locked into the hole of the conductive fabric, requiring to replace the entire connecting terminal in case of a contact failure due to surface oxidation of the contact by long usage or other causes.

The present invention has been conceived in view of the above circumstances. The invention provides a connector that is easy to connect to and disconnect from an electric conductor.

A connector of the present invention includes first and second beams, first and second conductive plates, and an urging device. The first and second beams extend substantially in parallel with each other and include first and second accommodating recesses, respectively. The first and second recesses are opposed to each other and open toward distal end sides of the first and second beams. The first and second conductive plates are to be accommodated in the first and second accommodating recesses, respectively, and removably insertable from the distal end sides into the first and second accommodating recesses, respectively. The urging device urges the first and second conductive plates in directions close to each other.

According to this aspect of the invention, when an electric conductor is inserted between the first and second conductive plates, the first and second conductive plates are urged by the urging device and brought into elastic contact with the electric conductor, so that the connector is connected to the electric conductor. Accordingly, there is no need to form a hole in the electric conductor, and the connector can be easily connected to and disconnected from the electric conductor. The connector is also easy to change its connection position with respect to the electric conductor. With no hole in the electric conductor, the invention can also prevent damage to the electric conductor due to perforation. Further, the invention makes it possible to removably insert the first and second conductive plates into the first and second accommodating recesses from the distal end sides of the first and second beams, so that it is easy to replace the conductive plates if oxidized or in any other trouble. As the first and second conductive plates are removably insertable into the accommodating recesses from the distal end sides, the connector is applicable to different kinds of electric conductors with different thicknesses by preparing different kinds of conductive plates with different thicknesses for replacement.

The first and second conductive plates may each include a first face provided with a projection, and a second face on an opposite side of the first face. In this case, the first and second conductive plates may be accommodated in the first and second accommodating recesses such that the first faces are opposed to each other. According to this aspect of the invention, the projections on the first faces of the first and second conductive plates are contactable with the electric conductor, so that the first and second conductive plates increase in friction resistance with respect to the electric conductor and thereby improve in holding force and tension strength with respect to the same. In addition, the projections on the first faces of the first and second conductive plates are elastically contactable with the electric conductor, stabilizing a contact resistance value of the connector with respect to the electric conductor can be obtained and thereby improving connection stability of the connector.

The urging device may be a spring member having electrical conductivity. The spring member may include first and second urging arms that are disposed in the first and second beams, respectively, and are abuttable against the second faces of the first and second conductive plates, respectively, and a connecting portion. A gap distance between the first and second urging arms may be smaller than a sum of thickness dimensions of the first and second conductive plates and a thickness dimension of the electric conductor. According to this aspect of the invention, when the electric conductor is inserted between the first and second urging arms of the spring member, the first and second urging arms elastically abut the second faces of the first and second conductive plates, respectively, so that the first and second conductive plates are pressed onto the electric conductor to establish a stable electrical connection. Further, the spring member has the connecting portion that can be connected to another member. That is, the spring member serves the urging device and also serves as a connecting terminal, making it possible to reduce the number of components of the connector as compared with the case in which an additional connecting terminal is provided. The connector can therefore be manufactured with a reduced cost.

Alternatively, if the first and second beams are made of elastically deformable material, they may serve as the urging device for urging the first and second conductive plates in the directions close to each other. According to this aspect of the invention, as the first and second beams also serve as the urging device, it is possible to reduce the number of components of the connector and thereby reduce the cost of the connector.

The connector of the invention may further include a first holder and a second holder. The first holder may be embedded with the first conductive plate such that the first face of the first conductive plate is exposed. The first holder and the embedded first conductive plate may be removably accommodated in the first accommodating recess from the distal end side. The second holder may be embedded with the second conductive plate such that the first face of the second conductive plate is exposed. The second holder and the embedded second conductive plate may be removably accommodated in the second accommodating recess from the distal end side.

The connector of the invention may further include a flexible coupler to couple the first and second holders. According to this aspect of the invention, the coupler integrates the first and second holders. The integrated first and second holders can be removably inserted together into the first and second accommodating recesses from the distal end sides. This eases replacement of the first and second holders and the first and second conductive plates.

The first and second holders may have first and second locking arms, respectively, that are elastically deformable. The first beam may include a wall and a bottom of the first accommodating recess, and the second beam may include a wall and a bottom of the second accommodating recess. The first and second locking arms may each be provided at a distal end portion thereof with a locking claw. The walls or the bottoms may be provided with locking holes that pass through the walls or the bottoms and are configured to lock the locking claws therein.

According to this aspect of the invention, when the first and second holders are inserted into the first and second accommodating recesses, respectively, from the distal end sides of the first and second beams, the first and second locking arms of the first and second holders are elastically deformed, and then, the locking claws of the first and second locking arms are locked in the locking holes of the first and second beams. This prevents the first and second holders from accidentally falling out of the first and second accommodating recesses. In addition, when the locking claws of the first and second locking arms are operated through the locking holes, the first and second locking arms are elastically deformed to disengage the locking claws from the locking holes. Accordingly, the invention makes it easy to disengage the locking claws form the locking holes.

It is preferable that the projections are square pyramid shaped. This aspect of the invention increases surface areas of the projections. Accordingly, the first and second conductive plates further increase in friction resistance and thereby further improve in holding force and tension strength with respect to the electric conductor.

The second faces of the first and second conductive plates may be provided with first and second locking recesses, respectively, to lock distal end portions of the first and second urging arms thereto. According to this aspect of the invention, the distal end portions of the first and second urging arms of the spring member are locked in the first and second locking recesses of the first and second conductive plates, so that the first and second urging arms further improve in holding force with respect to the first and second conductive plates.

The connector of the invention may further include a cable that is electrically connected to the connecting portion.

DESCRIPTION OF EMBODIMENTS

Figure 1A:
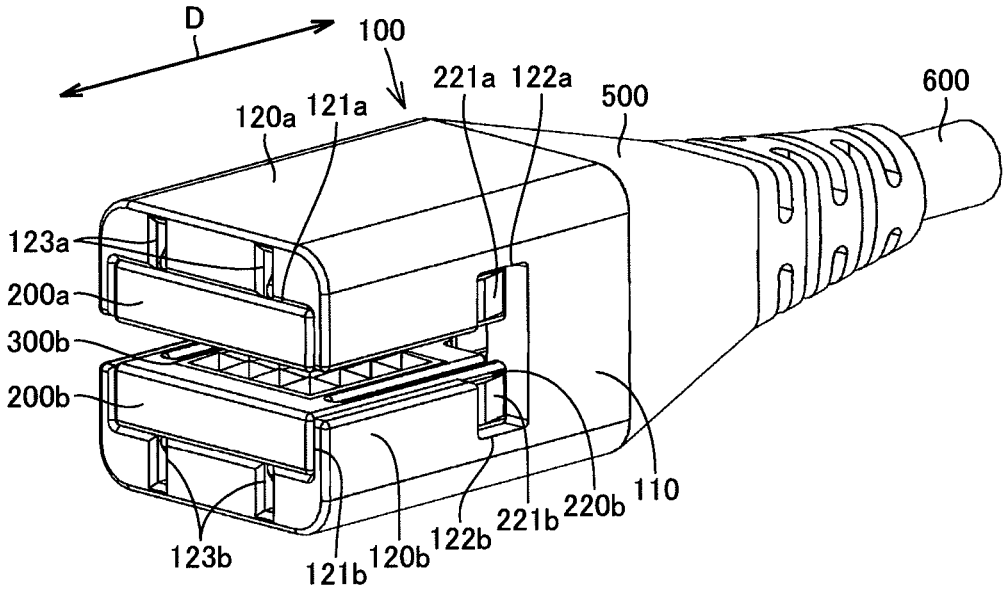
FIG. 1A is a schematic perspective view showing a front top right side of a connector according to an embodiment of the present invention.
Figure 1B:
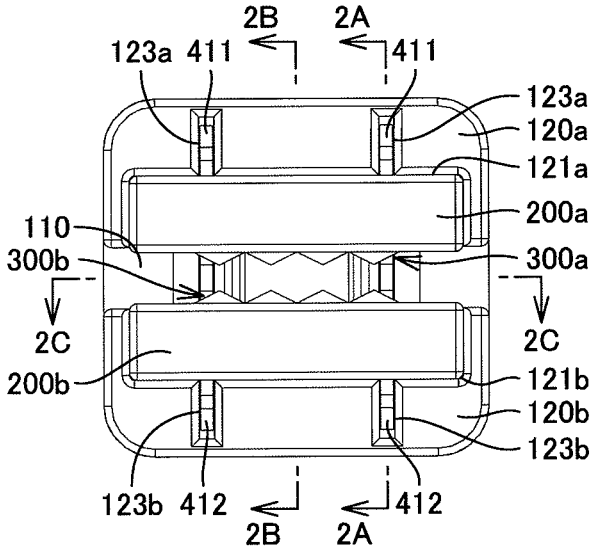
FIG. 1B is a schematic front view of the connector.

A connector according to an embodiment of the present invention will be described with reference to FIGS. 1A to 7B. The connector is configured for connection with a flexible conductive fabric (electric conductor) not shown. As shown in FIGS. 1A to 2C, the connector includes a body 100, holders 200*a* and 200*b* (first and second holders), a coupling belt 200*c* (coupler), conductive plates 300*a* and 300*b* (first and second conductive plates), a pair of spring clips 400 (spring members that serve as urging devices), a bush 500, and a cable 600. The respective elements of the connector will be described in detail below. It should be noted that FIGS. 1A, 2A, and 3 shows a fore-aft direction with a reference sign D for the convenience of describing the embodiment.

As shown in FIGS. 2A to 5, the conductive plates 300*a* and 300*b* are identical, generally rectangular metal plates having electrical conductivity. The conductive plate 300*a* has a first face 301*a* and a second face 302*a* on the opposite side thereof. A plurality of projections 310*a* of square pyramid shape are arranged in a matrix on the first face 301*a*. The conductive plate 300*b* has a first face 301*b* and a second face 302*b* on the opposite side thereof. A plurality of projections 310*b* of square pyramid shape are arranged in a matrix on the first face 301*b*.

Figure 3:
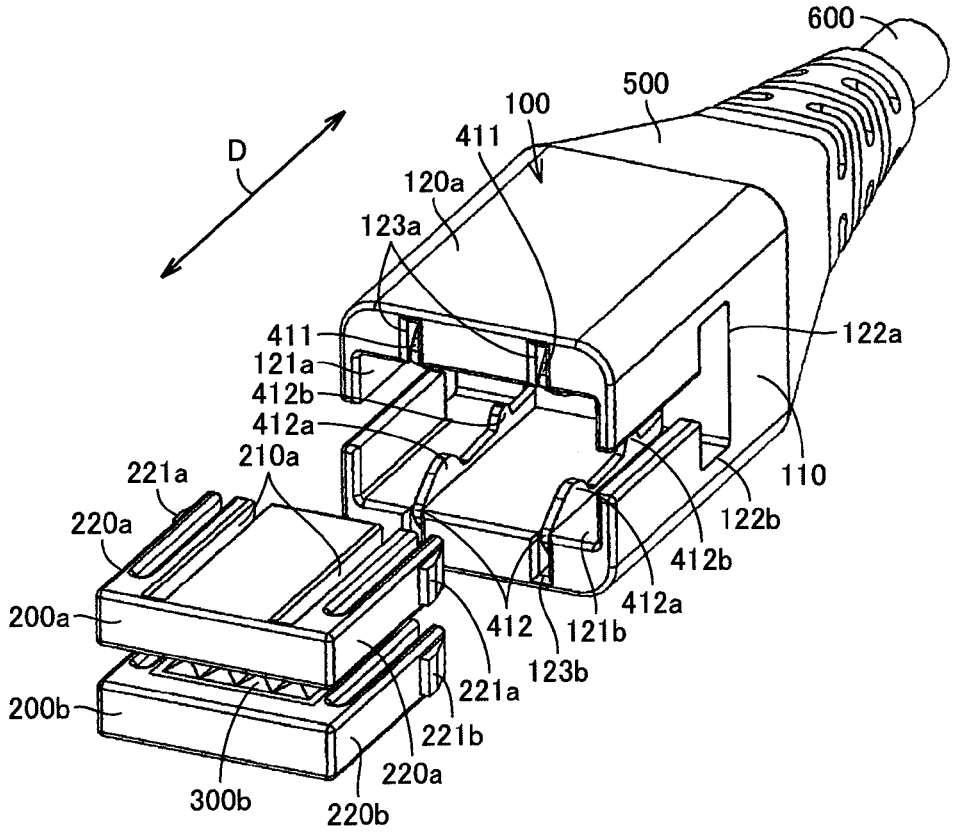
FIG. 3 is a schematic perspective view of the connector with its first and second conductive plates, first and second holders, and coupler removed from its body.
Figure 4:
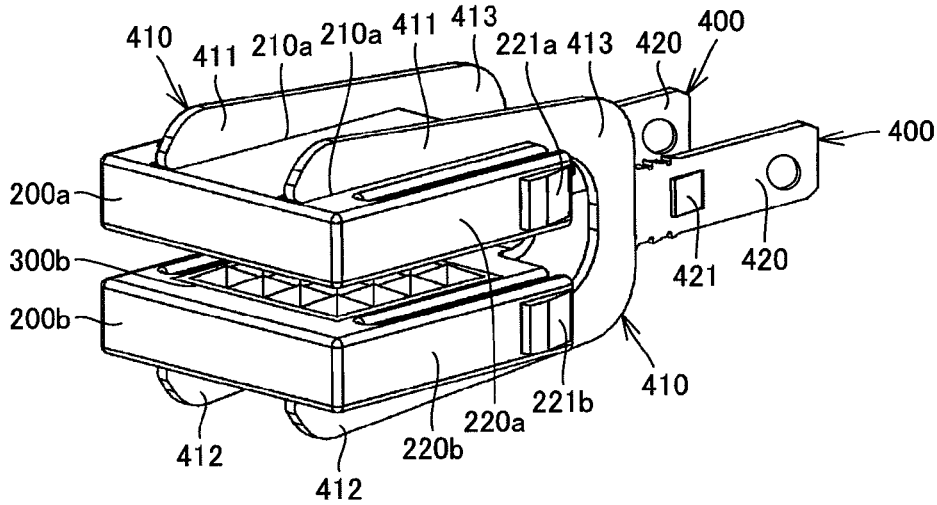
FIG. 4 is a schematic perspective view illustrating a locked state of the first and second conductive plates, the first and second holders, and spring clips of the connector.
Figure 5:
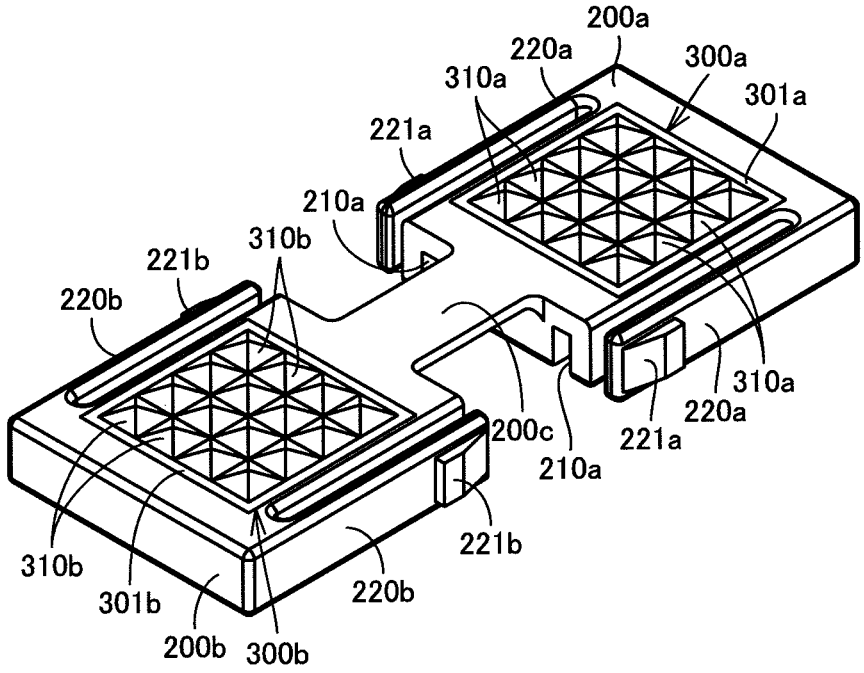
FIG. 5 is a schematic perspective view of the first and second conductive plates, the first and second holders, and the coupler of the connector.

The holders 200*a* and 200*b* are identical, generally rectangular plates made of insulating resin. As shown in FIGS. 2A and 2B, the conductive plate 300*a* is embedded in one thickness end of the holder 200*a* such that the first face 301*a* is exposed. As shown in FIGS. 3 to 5, the other thickness end of the holder 200*a* is provided with a pair of slots 210*a* extending in the fore-aft direction D, substantially in parallel with each other. The slots 210*a* pass through from the second face 302*a* of the conductive plate 300*a* to the other end face in the thickness direction of the holder 200*a* (see FIG. 2A). Rear ends of the slot 210*a* are open. At opposite corners in the distal end of the holder 200*a*, there is a pair of locking arms 220*a* (first locking arms) extending rearward. Each locking arms 220*a* has a locking claw 221*a* on an outer face of its rear end.

Figure 2A:
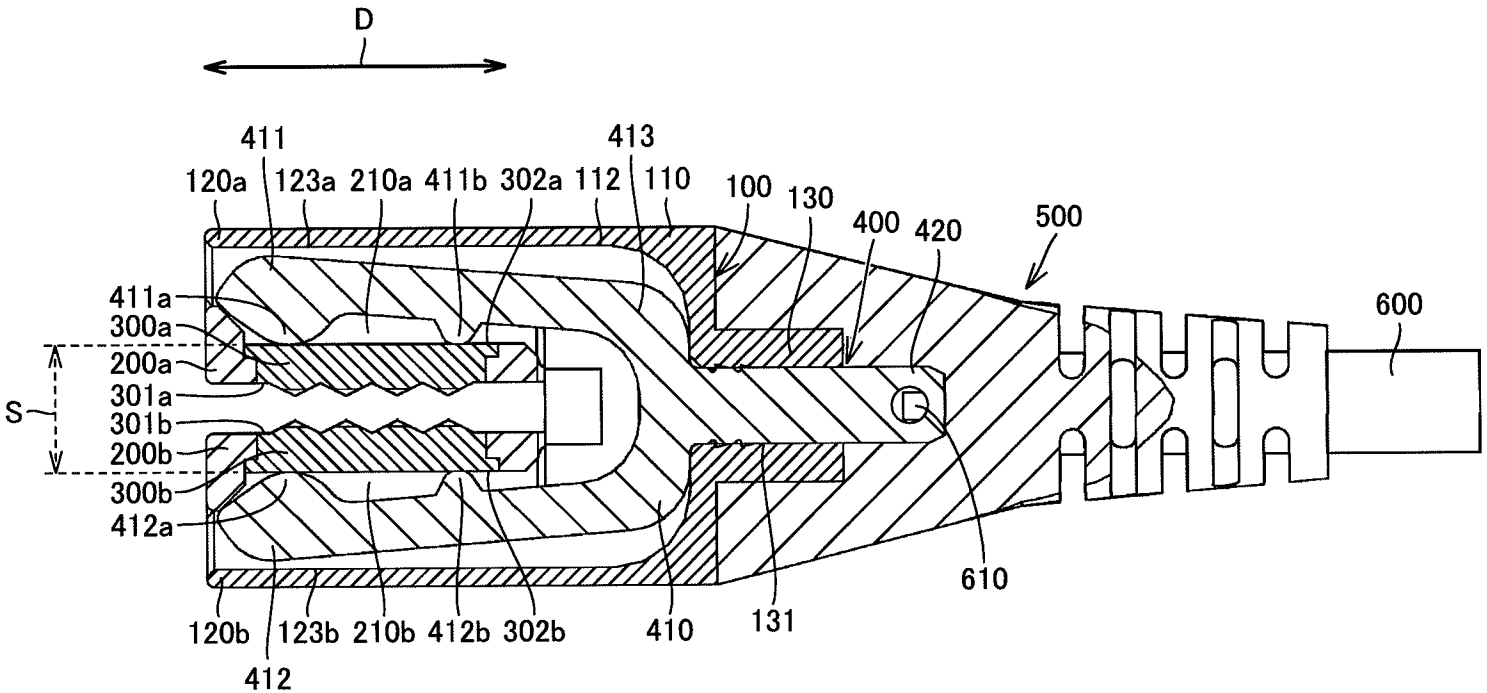
FIG. 2A is a cross-sectional view of the connector taken along line 2A-2A in FIG. 1B.
Figure 2B:
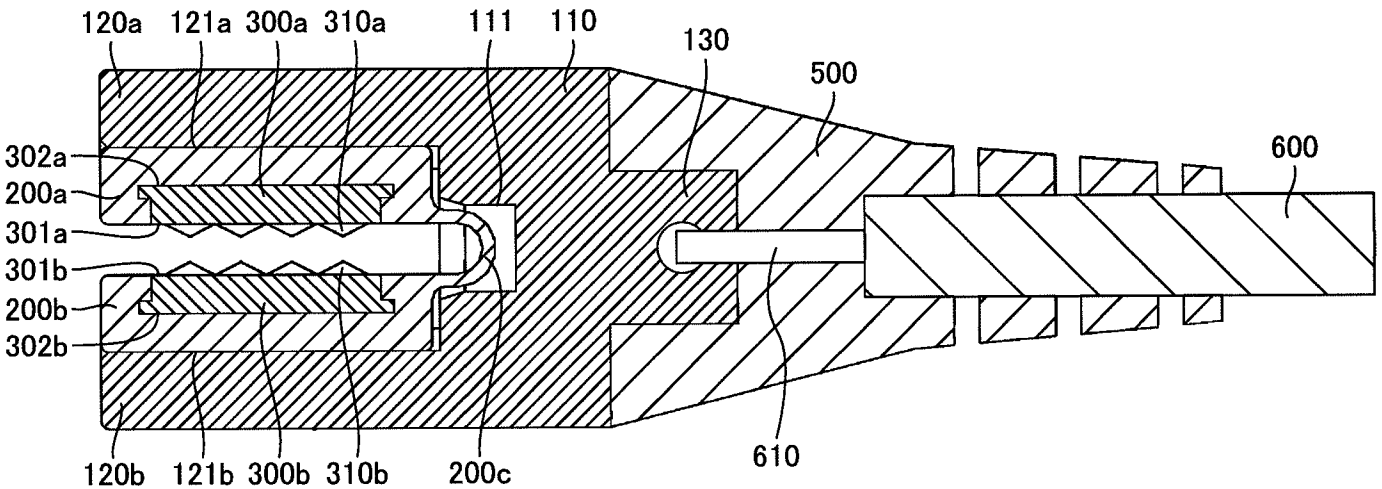
FIG. 2B is a cross-sectional view of the connector taken along line 2B-2B in FIG. 1B.

The conductive plate 300*b* is embedded in one thickness end of the holder 200*b* such that the first face 301*b* is exposed, as shown in FIGS. 2A and 2B. As shown in FIGS. 3 to 5, the other thickness end of the holder 200*b* is provided with a pair of slots 210*b* extending in the fore-aft direction D, substantially in parallel with each other. The slots 210*b* pass through from the second face 302*b* of the conductive plate 300*b* to the other end face in the thickness direction of the holder 200*b* (see FIG. 2A). Rear ends of the slot 210*b* are open. At opposite corners in the distal end of the holder 200*b*, there is a pair of locking arms 220*b* (second locking arms) extending rearward. Each locking arms 220*b* has a locking claw 221*b* on an outer face of its rear end.

As shown in FIG. 5, the coupling belt 200*c* is an elongated flexible belt made of the same insulating resin as the holders

200*a* and 200*b*. The coupling belt 200*c* couples rear ends of the holders 200*a* and 200*b*. As shown in FIG. 2B, when the coupling belt 200*c* is bent in a generally U shape, the conductive plate 300*a* embedded in the holder 200*a* and the conductive plate 300*b* embedded in the holder 200*b* are oriented to face each other.

Figure 1C:
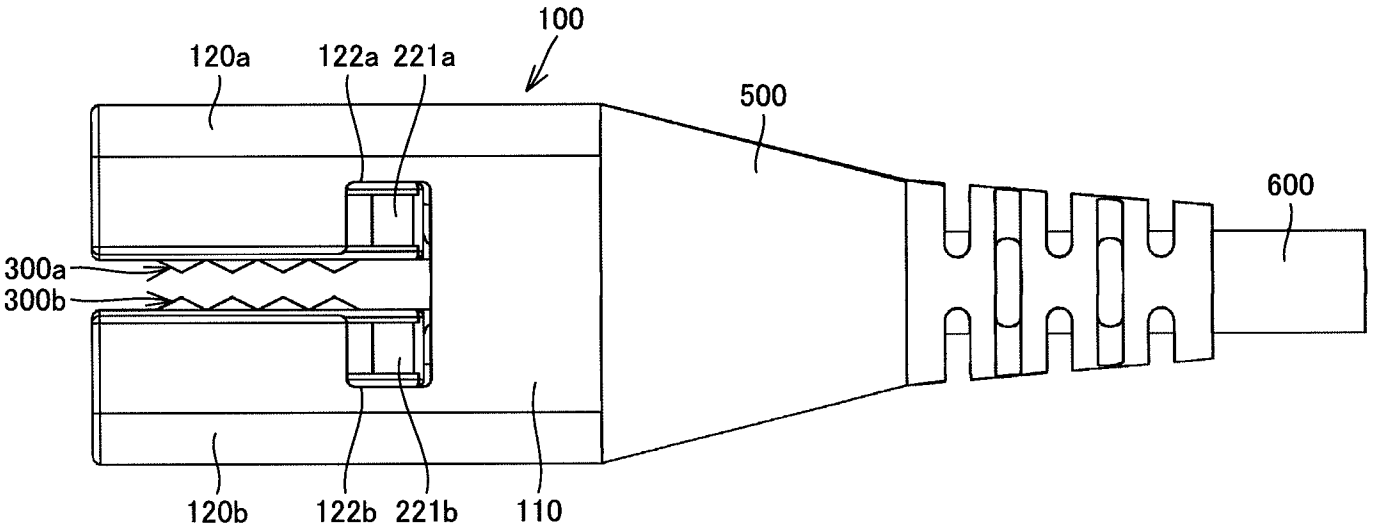
FIG. 1C is a schematic side view of the connector.
Figure 1D:
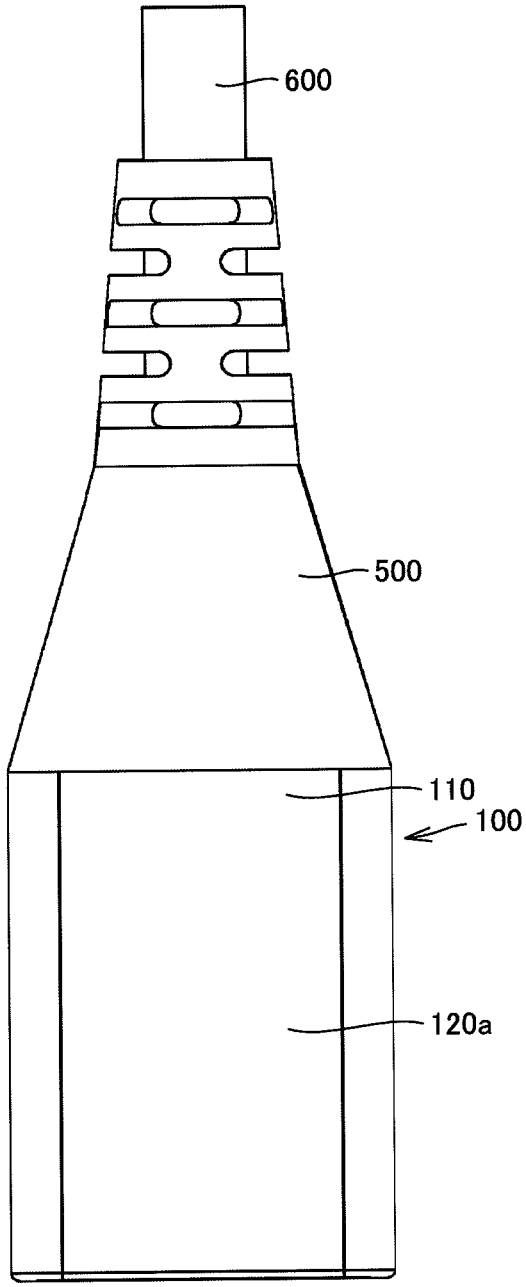
FIG. 1D is a schematic plan view of the connector.
Figure 2C:
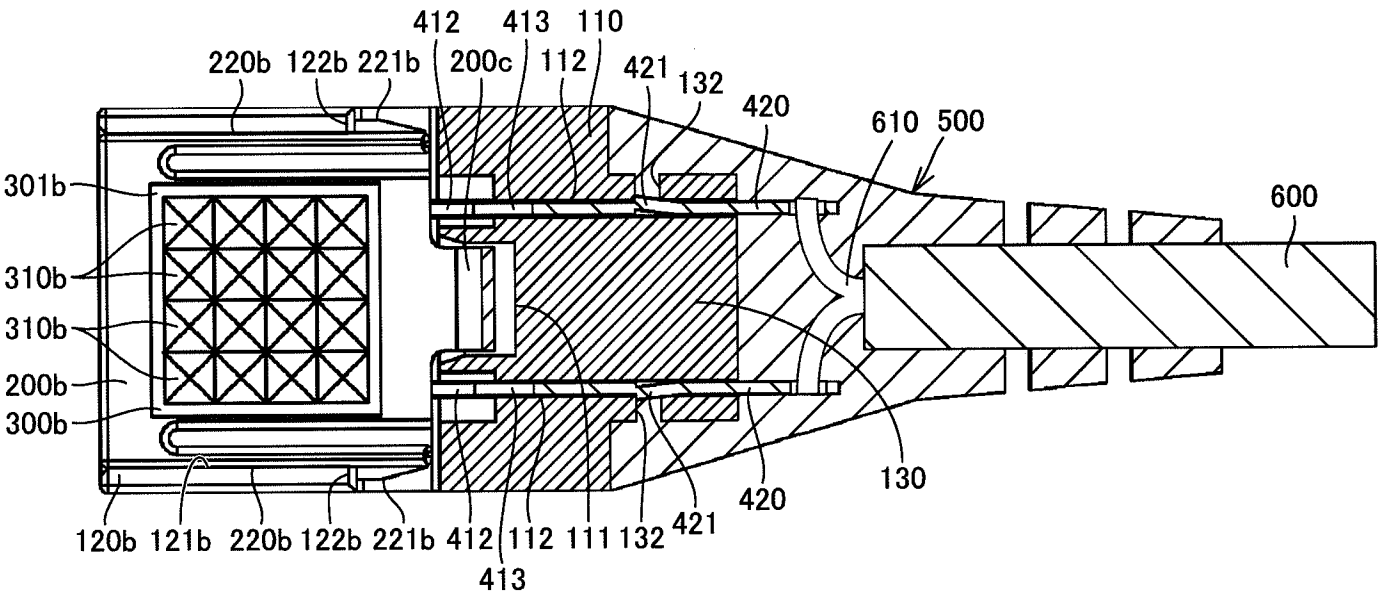
FIG. 2C is a cross-sectional view of the connector taken along line 2C-2C in FIG. 1B.
Figure 7A:
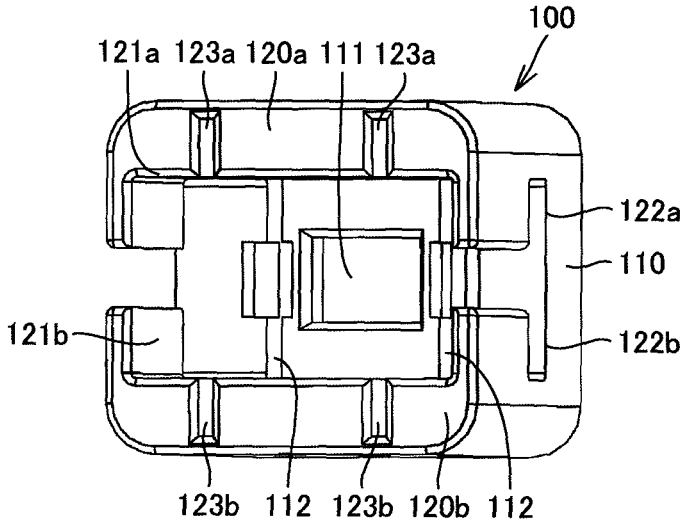
FIG. 7A is a schematic perspective view showing a front top right side of the body of the connector.

As shown in FIGS. 1A and 1C, the body 100 is an insulating resin block of generally lateral U shape in side view. The body 100 has a base 110, beams 120*a* and 120*b* (first and second beams), and a protrusion 130. The base 110 is generally rectangular and has front and rear faces in the fore-aft direction D. As shown in FIGS. 2C and 7A, a generally rectangular hole 111 is formed in the center of the front face of the base 110. The hole 111 is to receive the coupling belt 200*c* bent in a generally U shape. A pair of slits 112 extend in the fore-aft direction D one on each side of the hole 111 in the front face of the base 110, as shown in FIGS. 2C and 7A. From upper and lower ends of the front face of the base 110 extend the plate-shaped beams 120*a* and 120*b*, respectively, substantially in parallel with and opposed to each other.

The beam 120*a* has an accommodating recess 121*a* (first accommodating recess) in its lower end, i.e. at a portion facing the beam 120*b*. The accommodating recess 121*a* is open toward a distal end of the beam 120*a*. The accommodating recess 121*a* of generally rectangular shape has slightly larger outer dimensions than those of the holder 200*a*. The accommodating recess 121*a* removably accommodates the conductive plate 300*a* and the holder 200*a* from the distal end of the beam 120*a*.

As shown in FIGS. 1A and 2C, the side walls in the width direction of the accommodating recess 121*a* of the beam 120*a* are provided with a pair of generally rectangular locking holes 122*a* passing through the side walls. The locking holes 122*a* lockingly receive the locking claws 221*a* of the locking arms 220*a* of the holder 200*a* to prevent the holder 200*a* and the conductive plate 300*a* from falling out of the accommodating recess 121*a* of the beam 120*a*. When the locking claws 221*a* are pressed inward through the locking holes 122*a*, the locking arms 220*a* are elastically deformed inward to disengage the locking claws 221*a* from the locking hole 122*a*. The holder 200*a* and conductive plate 300*a* are thus removed from the accommodating recess 121*a* of the beam 120*a*.

As shown in FIGS. 2A and 7A, a pair of slits 123*a* is formed above and in communication with the accommodating recess 121*a* of the beam 120*a*. The slits 123*a* extend in the fore-aft direction D and communicate with upper ends of the slits 112 of the base 110. The slits 123*a* are open toward the distal end of the beam 120*a*.

The beam 120*b* has an accommodating recess 121*b* (second accommodating recess) at its upper end, i.e. at a portion facing the beam 120*a*. The accommodating recess 121*b* is open toward a distal end side of the beam 120*b*. The accommodating recess 121*b* of a generally rectangular shape has slightly larger outer dimensions than those of the holder 200*b*. The accommodating recess 121*b* is opposed to the accommodating recess 121*a* and removably accommodates the conductive plate 300*b* and the holder 200*b* from the distal end side of the beam 120*b*. The first face 301*a* of the conductive plate 300*a* and the first face 301*b* of the conductive plate 300*b* are opposed to each other in the state where the conductive plate 300*a* and the holder 200*a* are accommodated in the accommodating recess 121*a* and where the conductive plate 300*b* and the holder 200*b* are accommodated in the accommodating recess 121*b*. The conductive fabric is removably insertable between the first face 301*a* of the conductive plate 300*a* and the first face 301*b* of the conductive plate 300*b*.

As shown in FIGS. 1A and 2C, the side walls in the width direction of the accommodating recess 121*b* of the beam 120*b* are provided with a pair of generally rectangular locking holes 122*b* passing through the side walls. The locking holes 122*b* lockingly receive the locking claws 221*b* of the locking arms 220*b* of the holder 200*b* to prevent the holder 200*b* and the conductive plate 300*b* from falling out of the accommodating recess 121*b* of the beam 120*b*. When the locking claws 221*b* are pressed inward through the locking holes 122*b*, the locking arms 220*b* are elastically deformed inward to disengage the locking claws 221*b* from the locking hole 122*b*. The holder 200*b* and conductive plate 300*b* are thus removed from the accommodating recess 121*b* of the beam 120*b*.

As shown in FIGS. 2A and 7A, a pair of slits 123*b* is formed above and in communication with the accommodating recess 121*b* of the beam 120*b*. The slits 123*b* extend in the fore-aft direction D and communicate with lower ends of the slits 112 of the base 110. The slits 123*b* are open toward the distal end of the beam 120*a*.

Figure 7B:
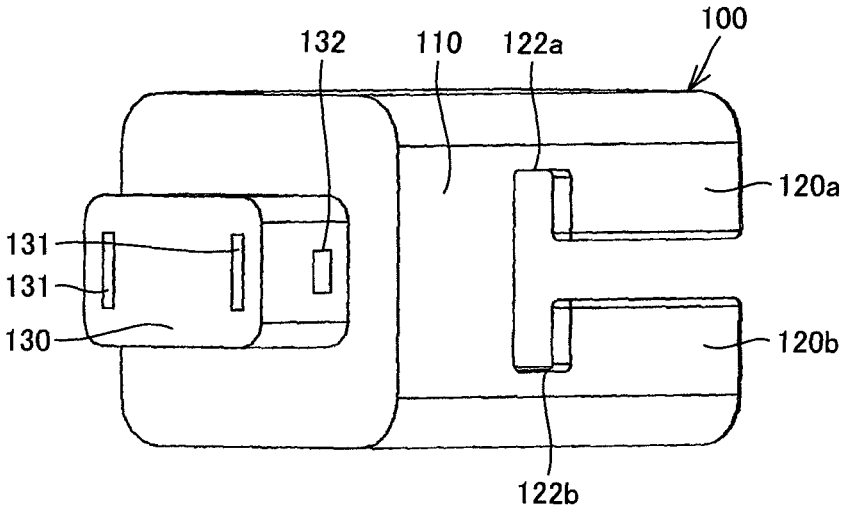
FIG. 7B is a schematic perspective view showing a rear top left side of the body of the connector.

The protrusion 130 is provided on the rear face of the base 110 as shown in FIG. 7B. As shown in FIGS. 2A and 2C, a pair of slits 131 pass through the protrusion 130 and communicate with the slits 112. As described above, as the slits 123*a* and 123*b* communicate with the slits 112 and the slits 112 communicate with the slits 131, the slits 123*a*, 123*b*, 112, and 131 constitute two slit sets to each receive one of the spring clips 400. In addition, a pair of generally rectangular lock holes 132 are formed in the opposite side faces in the width direction of the protrusion 130. As shown in FIG. 2C, the lock holes 132 communicates with the respective slits 131.

Figure 6:
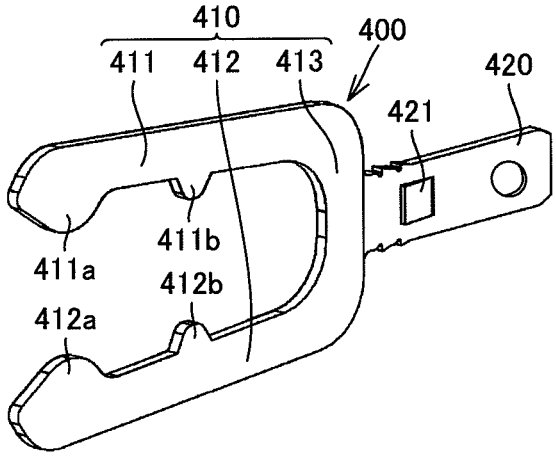
FIG. 6 is a schematic perspective view of the spring clip of the connector.

As shown in FIGS. 2A and 6, the spring clips 400 are metal plates having electrical conductivity. Each spring clip 400 has a clamp 410 of substantially lateral U shape in side view and a connecting portion 420 of rectangular shape. The clamp 410 has urging arms 411 and 412 (first and second urging arms) and an intermediate portion 413 that connects the urging arms 411 and 412. The intermediate portion 413 is to be accommodated in one of the slits 112 of the base 110. The urging arm 411 is to be accommodated in the slit 123*a* of the beam 120*a*, and the urging arm 412 is to be accommodated in the slit 123*b* of the beam 120*b*. Protrusions 411*a* and 411*b* are provided at an inner end of the urging arm 411, and protrusions 412*a* and 412*b* are provided along an inner end of the urging arm 412. The protrusion 411*b* is smaller than the protrusion 411*a*, and a distal end of the protrusion 411*a* is at the same height position as a distal end of the protrusion 411*b*. The protrusion 412*b* is also smaller than the protrusion 412*a*, and a distal end of the protrusion 412*a* is at the same height position as a distal end of the protrusion 412*b*. The protrusions 411*a* and 411*b* are to be inserted into one of the slots 210*a* of the holder 200*a* so as to abut the second face 302*a* of the conductive plate 300*a*, while the protrusions 412*a* and 412*b* are to be inserted into one of the slots 210*b* of the holder 200*b* so as to abut the second face 302*b* of the conductive plate 300*b*. A gap distance S from the protrusions 411*a* and 411*b* of the urging arm 411 to the protrusions 412*a* and 412*b* of the urging arm 412 is smaller than the sum of thickness dimensions of the conductive plates 300*a* and 300*b* and a thickness dimension of the conductive fabric. As such, when the conductive fabric is inserted between the conductive plates 300*a* and 300*b*, the urging arm 411 urges the second face 302*a* of the conductive plate 300*a* and the urging arm 412 urges the second face 302*b* of the conductive plate 300*b*. The conductive plates 300*a* and 300*b* are thus urged in directions close to each other, and the conductive fabric is elastically held between the conductive plates 300*a* and 300*b*.

The connecting portion 420 is a rectangular plate extending from the intermediate portion 413 of the clamp 410 to an opposite side of the urging arms 411 and 412. The connecting portion 420 is larger in length than the protrusion 130. Accordingly, when pressed into one of the slits 131 of the protrusion 130, the connecting portion 420 passes through the protrusion 130. The connecting portion 420 has a lock piece 421 to be locked in one of the lock holes 132 of the protrusion 130. The lock piece 421 locked in the lock hole 132 prevents the spring clip 400 from falling out of the body 100. The connecting portion 420 is to be electrically connected at its rear end with a core wire 610 of the cable 600. In this embodiment, the core wire 610 of the cable 600 is inserted into a connection hole formed at the rear end of the connecting portion 420 and is connected to the connecting portion 420 by soldering. Alternatively, slots may be formed in widthwise ends of the rear end of the connecting portion 420 to engage and solder the core wire 610 of the cable 600 with the slots.

The bush 500 is a generally square pyramid member of insulating resin and is detachably attached to a rear end of the base 110. The protrusion 130 of the base 110, the rear end of the connecting portion 420 of the spring clip 400, an end of the cable 600, and the core wire 610 taken from the end of the cable 600 are embedded in the bush 500.

The connector may be configured as described above and may be assembled in the following steps. The first step is to prepare the body 100 produced by a known injection molding method and a pair of spring clips 400 produced by a known press molding method. Thereafter, the connecting portions 420 of the spring clips 400 are inserted through the pair of slits 112 of the body 100 and into the pair of slits 131 of the protrusion 130 to project the rear ends of the connecting portions 420 out of the protrusion 130. Then, the lock pieces 421 of the connecting portions 420 are locked in the pair of lock holes 132 of the protrusion 130. Simultaneously, the intermediate portions 413 of the clamps 410 of the spring clips 400 are inserted into the pair of slits 112 of the body 100, and the urging arms 411 and 412 of the spring clips 400 are inserted into the pair of slits 123*a* and 123*b* of the beams 120*a* and 120*b*.

The next step is to prepare the cable 600. The core wire 610 of the cable 600 is inserted into the connection holes in the rear ends of the connecting portions 420 and then soldered to the connecting portions 420. Thereafter, the body 100, the spring clips 400, and the cable 600 are placed in a die (not shown), and insulating resin is poured into the die to mold the bush 500. The bush 500 is thus produced, embedded with the protrusion 130 of the base 110, the rear ends of the connecting portions 420 of the spring clips 400, the end of the cable 600, and the core wire 610 taken from the end of the cable 600.

Also prepared are the conductive plates 300*a* and 300*b* produced by a known casting method such as aluminum die casting. The conductive plates 300*a* and 300*b* are insert molded with insulating resin to produce the holders 200*a* and 200*b* embedded with the conductive plates 300*a* and 300*b* and the coupling belt 200*c*.

Thereafter, the coupling belt 200*c* is bent into a generally U shape such that the first face 301*a* of the conductive plate 300*a* and the first face 301*b* of the conductive plate 300*b* are opposed to each other. The bent coupling belt 200*c* is inserted into the hole 111 of the body 100, the holder 200*a* is inserted into the accommodating recess 121*a* of the beam 120*a* from the distal end of the beam 120*a*, and the holder 200*b* is inserted into the accommodating recess 121*b* of the beam 120*b* from the distal end of the beam 120*b*. Then, the pair of locking claws 221*a* of the locking arms 220*a* of the holder 200*a* are fitted and locked into the pair of locking holes 122*a* of the beam 120*a*, and the locking claws 221*b* of the pair of locking arms 220*b* of the holder 200*b* are fitted and locked into the pair of locking holes 122*b* of the beam 120*b*. At this time, the protrusions 411*a* and 411*b* of the urging arms 411 of the spring clips 400 are inserted into the pair of slots 210*a* of the holder 200*a* so as to abut the second face 302*a* of the conductive plate 300*a*, and the protrusions 412*a* and 412*b* of the urging arms 412 of the spring clips 400 are inserted into the pair of slots 210*b* of the holder 200*b* so as to abut the second face 302*b* of the conductive plate 300*b*. Consequently, the pair of spring clips 400 are electrically connected to the conductive plates 300*a* and 300*b*.

In the connector assembled in the above manner, the conductive plates 300*a* and 300*b* may be replaced in the following steps. First, the locking claws 221*a* of the pair of locking arms 220*a* of the holder 200*a* are pressed inward through the pair of locking holes 122*a* of the body 100. Then, the locking arms 220*a* are elastically deformed inward to disengage the locking claws 221*a* form the locking holes 122*a*. Likewise, the locking claws 221*b* of the pair of locking arms 220*b* of the holder 200*b* are pressed inward through the pair of locking holes 122*b* of the body 100. Then, the locking arms 220*b* are elastically deformed inward to disengage the locking claws 221*b* form the locking holes 122*b*. In this state, the holder 200*a* with the conductive plate 300*a* are pulled out of the accommodating recess 121*a* of the beam 120*a* toward the distal end of the beam 120*a*, and the holder 200*b* with the conductive plate 300*b* are pulled out of the accommodating recess 121*b* of the beam 120*b* toward the distal end of the beam 120*b*. Now the holders 200*a* and 200*b*, the conductive plates 300*a* and 300*b*, and the coupling belt 200*c* are removed from the body 100. A new set of holders 200*a* and 200*b*, conductive plates 300*a* and 300*b*, and coupling belt 200*c* is prepared and is attached to the body 100 in the steps described above.

The connector assembled in the above manner may be attached to the conductive fabric in the following manner. The conductive fabric is inserted between the conductive plates 300*a* and 300*b* of the connector, then the urging arms 411 of the pair of spring clips 400 are pressed upward by means of the conductive plate 300*a*, and the urging arms 412 of the pair of spring clips 400 are pressed downward by means of the conductive plate 300*b*. The urged urging arms 411 and 412 then urge back the conductive plates 300*a* and 300*b* in the directions close to each other, so that the conductive fabric is held between the conductive plates 300*a* and 300*b*. The projections 310*a* of the conductive plate 300*a* are brought into contact with a first electrode on a first face of the conductive fabric, and the projections 310*b* of the conductive plate 300*b* are brought into contact with a second electrode of a second face (opposite side of the first face) of the conductive fabric. The connector is thus connected to the conductive fabric. To remove the conductive fabric from the connector, the conductive fabric is pulled from between the conductive plates 300*a* and 300*b*.

In the connector as described above, the conductive fabric is elastically held between the conductive plates 300*a* and 300*b* for electrical connection, so that the connector can be easily connected to and disconnected from the conductive fabric, and there is no need to make a hole in the conductive fabric. It is therefore easy to change a connection position of the connector with respect to the conductive fabric. With no hole in the conductive fabric, the electrodes of the conductive fabric will not be damaged due to perforation. Further, the conductive plates 300*a* and 300*b* are removably insertable into the accommodating recesses 121*a* and 121*b* of the beams 120*a* and 120*b* from the distal ends of the beams 120*a* and

120*b*. It is accordingly easy to replace the conductive plates 300*a* and 300*b* if the conductive plates 300*a* and 300*b* undergo oxidation following an extended period of use of the connector. Another advantage of the conductive plates 300*a* and 300*b* that are removably insertable into the accommodating recesses 121*a* and 121*b* from the distal ends of the beams 120*a* and 120*b* is that the connector is applicable to different kinds of conductive fabrics with different thicknesses by preparing different kinds of conductive plates 300*a* and 300*b* with different thicknesses for replacement.

In addition, the projections 310*a* and 310*b* of square pyramid shape of the conductive plates 300*a* and 300*b* are brought into elastic contact with the first and second electrodes of the conductive fabric, increasing contact areas of the conductive plates 300*a* and 300*b* with respect to the first and second electrodes of the conductive fabric. Therefore, frictional resistance of the conductive plates 300*a* and 300*b* with respect to the conductive fabric is increased, improving a holding force and a tension strength of the connector with respect to the conductive fabric. Also, the projections 310*a* and 310*b* of square pyramid shape of the conductive plates 300*a* and 300*b* in elastic contact with the first and second electrodes of the conductive fabric can stabilize a contact resistance value of the connector with respect to the conductive fabric and thereby improving connection stability of the connector.

The connector of the invention is not limited to the above embodiment but may be modified in design within the scope of claims. Examples of the modifications will be described in detail below.

The first and second beams of the invention may extend substantially in parallel with each other from the upper and lower ends of the base 110 as in the beams 120*a* and 120*b* of the above embodiment. However, the first and second beams may have any other configuration as long as they extend substantially in parallel with each other and include the first and second accommodating recesses, respectively, that are opposed to each other.

The accommodating recesses of the invention are not limited to the ones according to the above embodiment, wherein the accommodating recesses 121*a* and 121*b* are open toward the distal end sides of the beams 120*a* and 120*b* and have generally rectangular shapes with slightly larger outer dimensions than those of the holders 200*a* and 200*b*. The accommodating recesses may be modified in design as long as they are open toward the distal end sides of the beams and have such outer shapes as to removably accommodate the holders or the conductive plates from the distal ends. In other words, the accommodating recesses may accommodate the holders or may directly accommodate the conductive plates. In the latter case, the holders and the coupler may be omitted.

The urging device of the invention may be configured like the spring clips 400 according to the above embodiment. However, the urging device may have any other configuration as long as it is adapted to urge the first and second conductive plates in directions close to each other. For example, the urging device may be a coil spring, a plate spring, or any other elastic member, which may be interposed between the first and second accommodating recesses and the holders or between the first and second accommodating recesses and the conductive plates so as to urge the first and second conductive plates in directions close to each other. Alternatively, the urging device may be the first and second beams made of an elastically deformable material and capable of approaching each other, in which case the first and second beams should urge the first and second conductive plates in directions close to each other. The spring clips 400 may electrically connect the first and second conductive plates to a cable or any other object to be connected, e.g. a printed circuit board. That is, the connecting portion of the urging device may be connectable to various kinds of objects to be connected. Also, the conductive plates 300*a* and 300*b* and the cable 600 may be electrically connected via the spring clips 400 serving as the urging device, as in the above embodiment. However, a certain connection device may be separately provided from the urging device to provide electrical connection between the first and second conductive plates and the cable. This separate connection device may connect between the first and second conductive plates and the object to be connected.

The first and second urging arms of the invention may be configured like the urging arms 411 and 412 with the protrusions 411*a*, 411*b*, 412*a*, and 412*b* according to the above embodiment. However, the first and second urging arms may be modified in design as long as the first and second urging arms are contactable to the second faces of the conductive plates.

The conductive plates of the invention may be configured like the conductive plates 300*a* and 300*b* being conductive metal plates manufactured by casting as in the above embodiment. However, the conductive plates may be any other plates having electrical conductivity. For example, they may be press-molded conductive metal plates. The second faces of the first and second conductive plates may be provided with first and second locking recesses to lock the first and second urging arms thereto. In this case, the first and second urging arms are to be locked in the first and second locking recesses of the first and second conductive plates, making it possible to improve a holding force of the first and second urging arms with respect to the first and second conductive plates.

The conductive plates of the invention may be provided with projections such as the square pyramid shaped projections 310*a* and 310*b* provided on the first faces 301*a* and 301*b* of the conductive plates 300*a* and 300*b*. However, the projections may be omitted if sufficient electrical continuity can be obtained by just bringing the first faces of the first and second conductive plates into surface contact with the electric conductor. The projections may be of square pyramid shape or any other convex shapes, such as triangular pyramid shapes and cut-and-raised teeth as used in graters.

The first and second holders of the invention are not limited to the holders 200*a* and 200*b* with the locking arms 220*a* and 220*b* according to the above embodiment, wherein the locking claws 221*a* and 221*b* of the locking arms 220*a* and 220*b* are adapted to be locked in the locking holes 122*a* and 122*b* of the beams 120*a* and 120*b*. Alternatively, the holders may be press-fitted, bonded, or locked by any other means into the first and second accommodating recesses of the first and second beams. Also, the locking claws of the invention may be configured like the locking claws 221*a* and 221*b* provided on the outer faces of the locking arms 220*a* and 220*b*. However, the locking claws may be provided on such faces of the first and second locking arms as to be opposed to bottoms of the first and second accommodating recesses. In this case, the locking holes are preferably through-holes provided in the bottoms of the first and second accommodating recesses, so that it is possible to operate the locking claws through the locking holes to disengage the locking claws from the locking holes.

The coupler of the invention may be configured like the coupling belt 200*c* that couples the holders 200*a* and 200*b*, but it may be modified in design as long as it is a flexible coupler to couple the first and second holders. The coupler may be omitted and the first and second holders may be separately provided.

The materials, shapes, dimensions, arrangements, etc. of the respective elements of the present connector have been described by way of example only, and they may be modified in design in any manner as long as they provide similar functions. Also, the electric conductor may be a flexible conductive fabric as in the above embodiment, but it may be any other electric conductor as long as it is adapted to be inserted for electrical connection between the first and second conductive plates of the connector. For example, the present invention is applicable to rigid plate-like electric conductors.

REFERENCE SIGNS LIST

| | |
|---|---|
| 100 | Body |
| 110 | Base |
| 111 | Hole |
| 112 | Slit |
| 120a | Beam (first beam) |
| 121a | Accommodating recess (first accommodating recess) |
| 122a | Locking hole |
| 123a | Slit |
| 120b | Beam (second beam) |
| 121b | Accommodating recess (second accommodating recess) |
| 122b | Locking hole |
| 123b | Slit |
| 130 | Protrusion |
| 131 | Slit |
| 132 | Lock hole |
| 200a | Holder (first holder) |
| 210a | Slot |
| 220a | Locking arm |
| 221a | Locking claw |
| 200b | Holder (second holder) |
| 210b | Slot |
| 220b | Locking arm |
| 221b | Locking claw |
| 300a | Conductive plate (first conductive plate) |
| 301a | First face |
| 302a | Second face |
| 310a | Projection |
| 300b | Conductive plate (second conductive plate) |
| 301b | First face |
| 302b | Second face |
| 310b | Projection |
| 400 | Spring clip (urging device: spring member) |
| 410 | Clamp |
| 411 | Urging arm (first urging arm) |
| 412 | Urging arm (second urging arm) |
| 413 | Intermediate portion |
| 420 | Connecting portion |
| 500 | Bush |
| 600 | Cable |

The invention claimed is:

1. A connector comprising:

first and second conductive plates;

first and second beams extending substantially in parallel with each other and including first and second accommodating recesses, respectively, the first and second recesses being opposed to each other, configured to accommodate the first and second conductive plates, and open toward distal end sides of the first and second beams to allow the first and second conductive plates to be inserted into and removed from the first and second accommodating recesses, respectively, through the distal end sides in a direction of the beams' extension;

and an urging device configured to urge the first and second conductive plates in directions close to each other.

2. The connector according to claim 1, wherein the first and second conductive plates each include:

a first face provided with a projection, and a second face on an opposite side of the first face, and the first and second conductive plates are accommodated in the first and second accommodating recesses such that the first faces are opposed to each other.

3. The connector according to claim 1, wherein the first and second beams are made of elastically deformable material and serve as the urging device for urging the first and second conductive plates in the directions close to each other.

4. The connector according to claim 2, wherein the projections are square pyramid shaped.

5. A connector comprising:

first and second beams extending substantially in parallel with each other and including first and second accommodating recesses, respectively, the first and second recesses being opposed to each other and open toward distal end sides of the first and second beams;

first and second conductive plates configured to be accommodated in the first and second accommodating recesses, respectively, and removably insertable from the distal end sides into the first and second accommodating recesses, respectively; and an urging device configured to urge the first and second conductive plates in directions close to each other, wherein the first and second conductive plates each include:

a first face provided with a projection, and a second face on an opposite side of the first face, and the first and second conductive plates are accommodated in the first and second accommodating recesses such that the first faces are opposed to each other, and wherein the connector is connectable to an electric conductor, the urging device comprises a spring member having electrical conductivity and including: first and second urging arms that are disposed in the first and second beams, respectively, and are abuttable against the second faces of the first and second conductive plates, respectively, and a connecting portion, and a gap distance between the first and second urging arms is smaller than a sum of thickness dimensions of the first and second conductive plates and a thickness dimension of the electric conductor.

6. The connector according to claim 5, wherein the second faces of the first and second conductive plates are provided with first and second locking recesses, respectively, to lock distal end portions of the first and second urging arms thereto.

7. The connector according to claim 5, further comprising a cable that is electrically connected to the connecting portion.

8. A connector comprising:

first and second beams extending substantially in parallel with each other and including first and second accommodating recesses, respectively, the first and second recesses being opposed to each other and open toward distal end sides of the first and second beams;

first and second conductive plates configured to be accommodated in the first and second accommodating recesses, respectively, and removably insertable from the distal end sides into the first and second accommodating recesses, respectively; and an urging device configured to urge the first and second conductive plates in directions close to each other, wherein the first and second conductive plates each include:

a first face provided with a projection, and a second face on an opposite side of the first face, and the first and second conductive plates are accommodated in the first and second accommodating recesses such that the first faces are opposed to each other, and the connector further comprising:

a first holder embedded with the first conductive plate such that the first face of the first conductive plate is exposed, wherein the first holder and the embedded first conductive plate are removably accommodated in the first accommodating recess from the distal end side; and a second holder embedded with the second conductive plate such that the first face of the second conductive plate is exposed, wherein the second holder and the embedded second conductive plate are removably accommodated in the second accommodating recess from the distal end side.

9. The connector according to claim 8, further comprising a flexible coupler to couple the first and second holders.

10. The connector according to claim 8, wherein the first and second holders have first and second locking arms, respectively, that are elastically deformable, the first beam includes a wall and a bottom of the first accommodating recess, and the second beam includes a wall and a bottom of the second accommodating recess, the first and second locking arms are each provided at a distal end portion thereof with a locking claw, and the walls or the bottoms are provided with locking holes that pass through the walls or the bottoms and are configured to lock the locking claws therein.

* * * * *